US011525201B2

(12) United States Patent
Lee et al.

(10) Patent No.: US 11,525,201 B2
(45) Date of Patent: Dec. 13, 2022

(54) METHOD OF CONTROLLING WASHING MACHINE AND WASHING MACHINE

(71) Applicant: Samsung Electronics Co., Ltd., Suwon-si (KR)

(72) Inventors: Ji-Yu Lee, Suwon-si (KR); Eun-Suk Bang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 219 days.

(21) Appl. No.: 16/946,378

(22) Filed: Jun. 18, 2020

(65) Prior Publication Data

US 2020/0399808 A1 Dec. 24, 2020

(30) Foreign Application Priority Data

Jun. 19, 2019 (KR) ..... 10-2019-0072944

(51) Int. Cl.

| | |
|---|---|
| ***D06F 33/38*** | (2020.01) |
| ***D06F 33/37*** | (2020.01) |
| ***D06F 35/00*** | (2006.01) |
| *D06F 33/34* | (2020.01) |
| *D06F 33/36* | (2020.01) |
| *D06F 105/02* | (2020.01) |
| *D06F 101/20* | (2020.01) |

(Continued)

(52) U.S. Cl.

CPC ..... *D06F 33/38* (2020.02); *D06F 33/37* (2020.02); *D06F 35/006* (2013.01); *D06F 33/34* (2020.02); *D06F 33/36* (2020.02); *D06F 34/28* (2020.02); *D06F 2101/20* (2020.02); *D06F 2105/02* (2020.02); *D06F 2105/42* (2020.02); *D06F 2105/46* (2020.02); *D06F 2105/56* (2020.02)

(58) Field of Classification Search

CPC .... D06F 33/37; D06F 35/005; D06F 2105/42; D06F 35/006; D06F 33/38

See application file for complete search history.

(56) References Cited

U.S. PATENT DOCUMENTS

| | | | | |
|---|---|---|---|---|
| 9,481,957 | B2 * | 11/2016 | Schulze | D06F 33/38 |
| 2005/0120759 | A1 | 6/2005 | Choi et al. | |
| 2017/0362759 | A1 | 12/2017 | Mamiya | |

FOREIGN PATENT DOCUMENTS

| | | |
|---|---|---|
| EP | 2835465 A2 | 2/2015 |
| EP | 3239381 A1 | 11/2017 |

(Continued)

OTHER PUBLICATIONS

Machine translation of JP 2014212886 A, dated Aug. 2017. (Year: 2017).*

(Continued)

*Primary Examiner* — Joseph L. Perrin
*Assistant Examiner* — Kevin G Lee

(57) ABSTRACT

In order to increase an adsorption rate of softener for laundry, a method of controlling a washing machine according to an embodiment includes performing a first rinsing process based on a first target water level and a first duty ratio of a motor; when a second rinsing process is started, supplying water to an intermediate water level of a fixed tub; additionally supplying water to a second target water level together with the softener; setting a duty ratio of the motor to a second duty ratio higher than the first duty ratio; and driving the motor based on the second duty ratio.

17 Claims, 13 Drawing Sheets

(51) Int. Cl.

| | |
|---|---|
| *D06F 105/46* | (2020.01) |
| *D06F 105/56* | (2020.01) |
| *D06F 34/28* | (2020.01) |
| *D06F 105/42* | (2020.01) |

(56) References Cited

FOREIGN PATENT DOCUMENTS

| | | | |
|---|---|---|---|
| JP | 2014-212886 | A | 11/2014 |
| JP | 2017-047050 | A | 3/2017 |
| KR | 10-2004-0046238 | A | 6/2004 |
| KR | 10-2008-0056600 | A | 6/2008 |
| KR | 10-2008-0079458 | A | 9/2008 |
| KR | 10-2014-0145326 | A | 12/2014 |
| KR | 10-2017-0100642 | A | 9/2017 |
| KR | 10-1835334 | B1 | 3/2018 |

OTHER PUBLICATIONS

Machine translation of KR 20140145326 A, dated Dec. 2014. (Year: 2014).*

International Search Report of the International Searching Authority in connection with International Application No. PCT/KR2020/007861 dated Oct. 13, 2020, 3 pages.

Supplementary European Search Report dated Apr. 8, 2022, in connection with European Application No. 20826292.3, 7 pages.

* cited by examiner

FIG.11

| WATER LEVEL | Normal | Normal + SELECT FRAGRANCE COURSE |
|---|---|---|
| 1 | 23100 (Hz) | 23100 (Hz) |
| 2 | 22700 (Hz) | 23100 (Hz) |
| 3 | 22300 (Hz) | 22700 (Hz) |
| 4 | 22200 (Hz) | 22600 (Hz) |
| 5 | 21800 (Hz) | 22200 (Hz) |

METHOD OF CONTROLLING WASHING MACHINE AND WASHING MACHINE

CROSS-REFERENCE TO RELATED APPLICATION

This application is based on and claims priority under 35 U.S.C. § 119 to Korean Patent Application No. 10-2019-0072944, filed on Jun. 19, 2019 in the Korean Intellectual Property Office, the disclosure of which is incorporated by reference in its entirety.

BACKGROUND

1. Field

The disclosure relates to a method of controlling a washing machine capable of increasing an adsorption rate of softener for laundry, and the washing machine.

2. Description of Related Art

Generally, washing machines are devices for doing laundry by rotating its cylindrical rotating tub that contains laundry. There are two general types of the washing machines. There are the washing machine that washes laundry by rotating the rotating tub with a horizontal axis as a rotation axis, so that the laundry is raised and dropped along an inner wall of the rotating tub, and the washing machine that rotates the rotating tub having a pulsator using a vertical axis as the rotation axis and washes laundry using water current produced by the pulsator. The washing machine in which the rotating tub is horizontally positioned is called a front loading washing machine because a laundry inlet is formed on the front, and the washing machine in which the rotating tub is vertically positioned is called a top loading washing machine because the laundry inlet is formed on the top. In addition, to take advantage of both of the above-described types, washing machines including a plurality of washing devices driven by different types have also appeared.

On the other hand, the washing machine may do laundry through a washing process for separating contamination of laundry with water (particularly, washing water) in which detergent is dissolved, a rinsing process for rinsing foam or residual detergent of the laundry with water (particularly, rinsing water) containing no detergent, and a dehydrating process for removing moisture contained in the laundry by high-speed rotation.

The rinsing process may include a course of injecting softener with water inside a washing tub, and in the prior art, the softener was injected at an initial stage of water supply for rinsing (particularly, final rinsing process). Therefore, there is a problem in that a degree of softener adsorption differs between laundry at the bottom of the washing tub and laundry at the top of the washing tub, and the softener is not evenly adsorbed by the laundry, so that the effect of the softener is not sufficiently utilized.

SUMMARY

An aspect of the disclosure is to provide a method of controlling a washing machine capable of increasing an adsorption rate of softener for laundry, and the washing machine.

Another aspect of the disclosure is to provide a method of controlling a washing machine capable of further increasing an adsorption rate of softener by optimizing driving of a motor in a final rinsing process, and the washing machine.

Additional aspects of the disclosure will be set forth in part in the description which follows and, in part, will be obvious from the description, or may be learned by practice of the disclosure.

In accordance with an aspect of the disclosure, a method of controlling a washing machine, the washing machine including a motor configured to rotate a rotating tub rotatably provided in a fixed tub and a detergent supply device configured to store softener, the method including performing a first rinsing process based on a first target water level and a first duty ratio of the motor; when a second rinsing process is started, supplying water to an intermediate water level of the fixed tub; additionally supplying water to a second target water level together with the softener; setting a duty ratio of the motor to a second duty ratio higher than the first duty ratio; and driving the motor based on the second duty ratio.

The driving of the motor may include driving the motor based on the second duty ratio for a first time.

The driving of the motor further may include driving the motor based on a third duty ratio lower than the first duty ratio for a second time after the first time elapses.

The second time may be longer than the first time.

The driving of the motor based on the second duty ratio may include driving the motor at a second rotation speed higher than a predetermined first rotation speed (RPM).

The method may further include receiving an input from a user selecting a fragrance course through a control panel; and setting the intermediate water level and the second target water level based on the selection of the fragrance course. The driving of the motor may include setting the duty ratio of the motor based on the selection of the fragrance course.

The method may further include activating a fragrance course button of the control panel based on a washing mode.

The setting of the second target water level may include setting the second target water level lower than the first target water level.

The setting of the second target water level may include when the first target water level is a lowest water level, setting the second target water level to be the same as the first target water level.

The second rinsing process may be a final rinsing process.

In accordance with another aspect of the disclosure, a washing machine includes a fixed tub configured to store water; a rotating tub rotatably provided in the fixed tub; a motor configured to rotate the rotating tub; a detergent supply device configured to store softener; a water supply valve provided on a water supply pipe connected to the fixed tub; and a controller configured to perform a first rinsing process based on a first target water level and a first duty ratio of the motor, when a second rinsing process is started, to control the water supply valve to supply water to an intermediate water level of the fixed tub, to control the water supply valve to supply additional water to a second target water level together with the softener, to set a duty ratio of the motor to a second duty ratio higher than the first duty ratio, and to drive the motor based on the second duty ratio.

The controller may be configured to drive the motor based on the second duty ratio for a first time.

The controller may be configured to drive the motor based on a third duty ratio lower than the first duty ratio for a second time after the first time elapses.

The second time may be longer than the first time.

The controller may be configured to drive the motor at a second rotation speed higher than a predetermined first rotation speed (RPM).

The washing machine may further include a control panel configured to receive an input from a user. The controller may be configured to set the intermediate water level, the second target water level, and the duty ratio of the motor based on the selection of a fragrance course inputted through the control panel.

The controller may be configured to activate a fragrance course button of the control panel based on a washing mode.

The controller may be configured to set the second target water level lower than the first target water level.

When the first target water level is a lowest water level, the controller may be configured to set the second target water level to be the same as the first target water level.

The second rinsing process may be a final rinsing process.

In accordance with another aspect of the disclosure, a washing machine includes a fixed tub configured to store water; a rotating tub rotatably provided in the fixed tub; a motor configured to rotate the rotating tub; a detergent supply device configured to store softener; a water supply valve provided on a water supply pipe connected to the fixed tub; at least one processor configured to be electrically connected to the motor and the water supply valve; and a memory configured to be electrically connected to the at least one processor. The memory may be configured to store at least one instruction set by the processor to perform a first rinsing process based on a first target water level and a first duty ratio of the motor, to control the water supply valve to supply water to an intermediate water level of the fixed tub when a second rinsing process is started, to control the water supply valve to supply additional water to a second target water level together with the softener, to set a duty ratio of the motor to a second duty ratio higher than the first duty ratio, and to drive the motor based on the second duty ratio.

The memory may be configured to store the at least one instruction set by the processor to drive the motor based on the second duty ratio for a first time, and to drive the motor based on a third duty lower than the first duty ratio for a second time after the first time elapses.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 11 is a view illustrating a setting of a second target water level.

DETAILED DESCRIPTION

Figure 1:
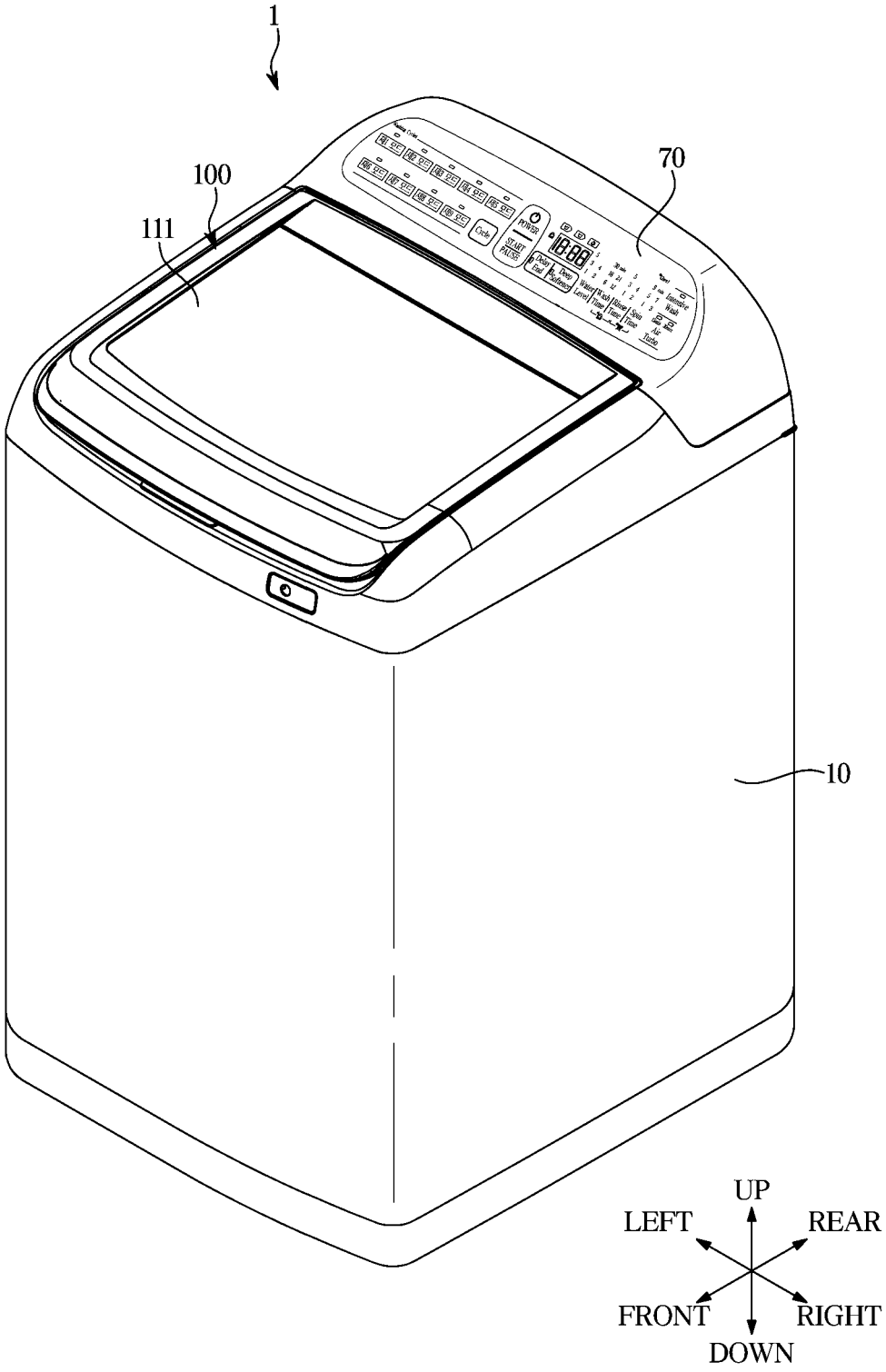
FIG. 1 is a perspective view illustrating a washing machine according to an embodiment.

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described herein and configurations illustrated in the accompanying drawings are only certain examples of the disclosure. Various modifications may be made at the time of filing of the present application to replace the embodiments and drawings of the present specification. The terms used herein are intended to only describe certain embodiments. The terms shall by no means restrict and/or limit the disclosure.

The terms as used throughout the specification, such as "~ part," "~ module," "~ member," "~ block," etc., may be implemented in software and/or hardware, and a plurality of "~ parts," "~ modules," "~ members," or "~ blocks" may be implemented in a single element, or a single "~ part," "~ module," "~ member," or "~ block" may include a plurality of elements. It is to be understood that the singular forms "a," "an," and "the" include plural referents unless the context clearly dictates otherwise. Also, it will be understood that, although the terms first, second, third, etc., may be used herein to describe various elements, it should not be limited by these terms. These terms are only used to distinguish one element from another element.

In addition, the terms such as "comprising," "having" or "including" are intended to designate the presence of characteristics, numbers, steps, operations, elements, parts or combinations thereof, and shall not be construed to preclude any possibility of the presence or addition of one or more other characteristics, numbers, steps, operations, elements, parts or combinations thereof.

As used herein, the terms "portion," "unit," "block," "member," or "module" refer to a unit that can perform at least one function or operation. For example, these terms may refer to at least one piece of software stored in a memory or at least one piece of hardware, such as a Field Programmable Gate Array (FPGA) or an Application Specific Integrated Circuit (ASIC), or at least one process that is processed by a processor.

Hereinafter, embodiments of the disclosure will be described in detail with reference to the accompanying drawings. In the drawings, the same reference numerals or signs given may refer to parts or components that perform substantially the same function.

Figure 2:
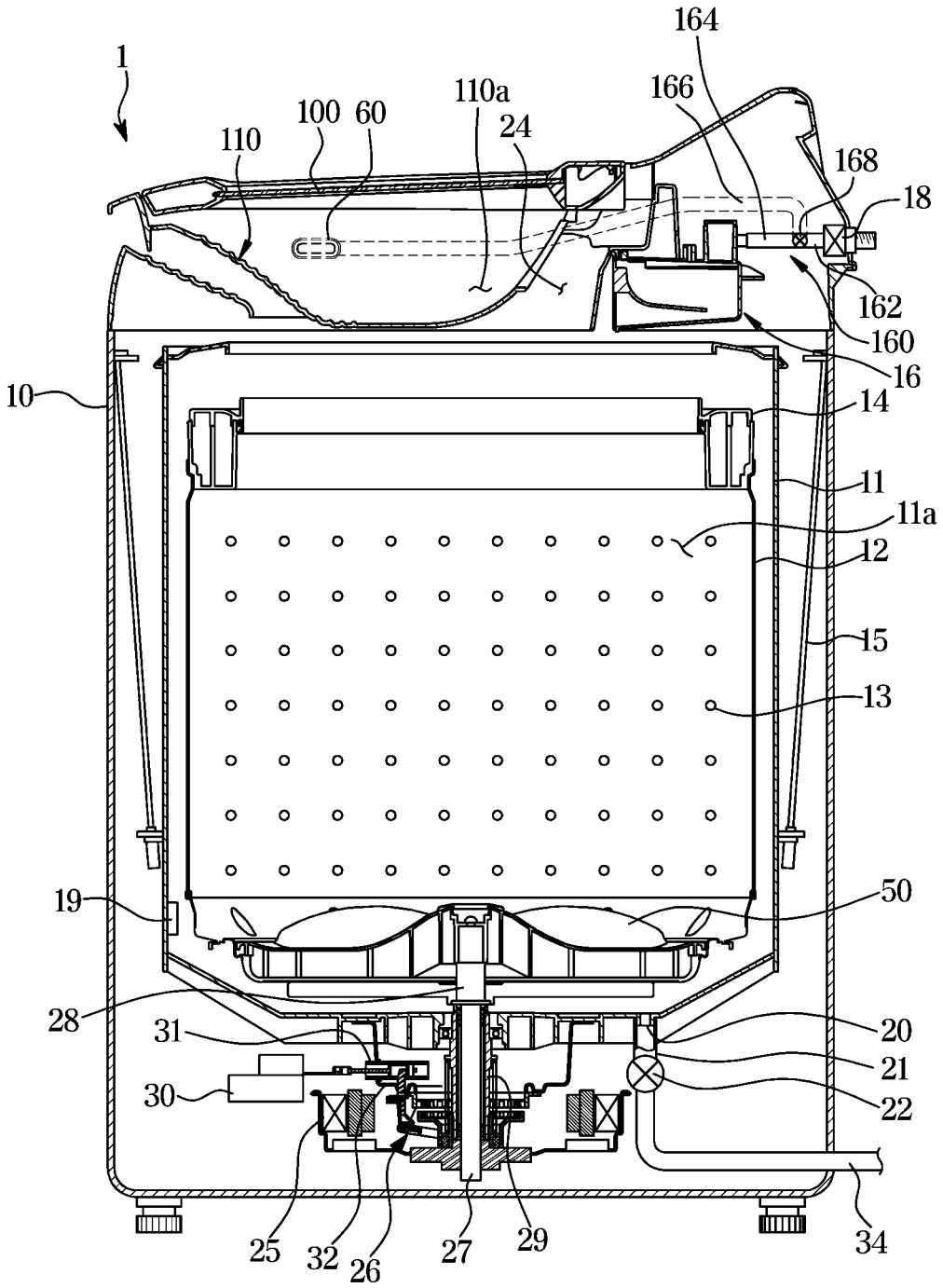
FIG. 2 illustrates a cross-sectional view of the washing machine illustrated in FIG. 1.
Figure 3:
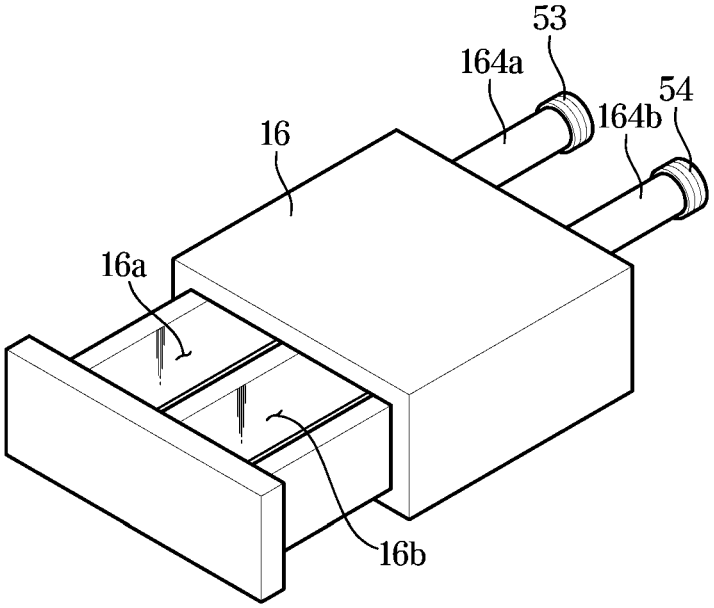
FIG. 3 is a perspective view illustrating a detergent supply device according to an embodiment.

FIG. 1 is a perspective view illustrating a washing machine according to an embodiment, FIG. 2 illustrates a cross-sectional view of the washing machine illustrated in FIG. 1, and FIG. 3 is a perspective view illustrating a detergent supply device according to an embodiment.

In FIG. 1, a side on which a door 100 of a washing machine 1 is disposed is referred to as an upper side and a bottom of the upper side is referred to as a lower side. In addition, a side where the door 100 of the washing machine 1 opens is referred to as a front side and an opposite side is referred to as a rear side. In addition, left of the front side is referred to as the left side, and right of the front side is referred to as the right side.

Meanwhile, a method of controlling the washing machine according to an embodiment may be applied to both a top loading washing machine and a front loading washing machine. However, for convenience of description, the embodiment of the disclosure will be described using the top loading washing machine in which a rotating tub rotates about a vertical axis.

Referring to FIGS. 1 and 2, the washing machine 1 may include a cabinet 10 forming an exterior, a fixed tub 11 disposed inside the cabinet 10 to store water, a rotating tub 12 rotatably disposed inside the fixed tub 11, and a pulsator 50 disposed inside the rotating tub 12 to generate water flow.

An inlet 24 may be formed at an upper portion of the cabinet 10 so that laundry can be introduced into the rotating tub 12. The inlet 24 may be opened and closed by the door 100 installed on the top of the cabinet 10. The door 100 may be provided on one side of the cabinet 10 and may be provided to open and close the inlet 24. The inlet 24 may be provided with the door 100 and an auxiliary washing device 110 provided under the door 100. In addition, the door 100 may include a transparent member 111 that allows an interior space to be seen even when the inlet 24 is closed.

The fixed tub 11 may be supported on the cabinet 10 by a suspension device 15. A water supply pipe 162 for supplying water to the fixed tub 11 may be installed at the upper portion of the fixed tub 11. One side of the water supply pipe 162 may be connected to an external water supply source, and the other side of the water supply pipe 162 may be connected to a detergent supply device 16. The water supplied through the water supply pipe 162 may be supplied into the fixed tub 11 together with detergent and/or softener via the detergent supply device 16. The water supply pipe 162 may be connected to a water supply valve 18 that can control the supply of water. The water supply valve 18 may be electrically connected to a controller 300.

Referring to FIGS. 2 and 3, a detergent supply device 16 may be provided on the upper portion of the cabinet 10, and the interior of the detergent supply device 16 may be divided into a plurality of spaces. That is, the detergent supply device 16 may include a detergent storage space **16*a* and a softener storage space 16*b***.

The rotating tub 12 may be provided in a cylindrical shape with an open top, and a plurality of dehydration holes 13 may be formed on the side surface of the rotating tub 12. A balancer 14 may be mounted on an upper portion of the rotating tub 12 so that the rotating tub 12 can stably rotate during high-speed rotation. A motor 25 for generating a driving force to rotate the rotating tub 12 and the pulsator 50, and a power switching device 26 for simultaneously or selectively transmitting the driving force generated from the motor 25 to the rotating tub 12 and the pulsator 50 may be installed outside the lower side of the fixed tub 11. The pulsator 50 may be installed to be rotatable inside the rotating tub 12, and may rotate left or right (forward or reverse) to generate water flow.

A hollow dehydration shaft 29 may be coupled to the rotating tub 12, and a washing shaft 27 installed in a hollow portion of the dehydration shaft 29 may be coupled to the pulsator 50 through a washing shaft coupling portion 28. The motor 25 may simultaneously or selectively transmit the driving force to the rotating tub 12 and the pulsator 50 according to a lifting operation of the power switching device 26. The power switching device 26 may include an actuator 30 that generates a driving force for power switching, a rod portion 31 that linearly moves according to the operation of the actuator 30, and a clutch portion 32 that is connected to the rod portion 31 and rotates according to the operation of the rod portion 31.

The motor 25 may be a direct drive motor capable of changing a rotation speed. In addition, the motor 25 may be implemented as a universal motor composed of a field coil and an armature, a BLDC motor composed of a stator and a rotor, a synchronous motor, a direct current motor (DC motor), or an induction motor. The motor applicable to the washing machine 1 is not limited thereto.

The motor 25 may stir the pulsator 50 left and right by rotating the washing shaft 27 in the forward or reverse direction while the washing shaft 27 and the dehydration shaft 29 are disengaged. In addition, the motor 25 may stir the rotating tub 12 and the pulsator 50 left and right at the same time by rotating the washing shaft 27 and the dehydration shaft 29 in the forward or reverse direction while the washing shaft 27 and the dehydration shaft 29 are bitten.

A drain 20 may be formed at the bottom of the fixed tub 11 to discharge water stored in the fixed tub 11, and a first drain pipe 21 may be connected to the drain 20. The first drain pipe 21 may be provided with a drain valve 22 that regulates drainage. An outlet of the drain valve 22 may be connected to a second drain pipe 34 for discharging water to the outside. In addition, a water level sensor 19 capable of detecting a water level (amount of water) in the fixed tub 11 may be installed inside the lower side of the fixed tub 11. The water level sensor 19 may detect a frequency that changes according to the water level.

The auxiliary washing device 110 may provide an auxiliary washing space 110*a*. The auxiliary washing space 110*a* is separated from a main washing space 11*a* formed by the fixed tub 11 and the rotating tub 12. Since the main washing space 11*a* and the auxiliary washing space 110*a* are separated, independent washing is possible in each space. In addition, washing in the main washing space 11*a* and the auxiliary washing space 110*a* may be simultaneously performed. The auxiliary washing device 110 may be provided to be rotatable around one side from the inside of the door 100. The auxiliary washing device 110 may be provided to have the same axis as a rotation axis of the door 100. In addition, the auxiliary washing device 110 may be separated from the washing machine 1.

The water supply device 160 may supply water to the main washing space 11*a* and the auxiliary washing space 110*a*. The water supply device 160 may include a main water supply pipe 164, an auxiliary water supply pipe 166, and a switching unit 168. One end of the water supply pipe 162 may be connected to the water supply valve 18, and the other end may be connected to the switching unit 168. The water supply pipe 162 may be branched into the main water supply pipe 164 and the auxiliary water supply pipe 166 starting from the switching unit 168.

The main water supply pipe 164 may supply water into the main washing space 11*a*. One end of the main water supply pipe 164 may be connected to the detergent supply device 16, and the other end of the main water supply pipe 164 may be connected to the switching unit 168. In addition, the main water supply pipe 164 may include a first water supply pipe 164*a* connected to the detergent storage space 16*a* of the detergent supply device 16 and a second water supply pipe 164*b* connected to the softener storage space 16*b*. In addition, a first water supply valve 53 may be installed in the first water supply pipe 164*a*, and a second water supply valve 54 may be installed in the second water supply pipe 164*b*. The auxiliary water supply pipe 166 may supply water into the auxiliary washing space 110*a*. One end of the auxiliary water supply pipe 166 may be connected to an auxiliary water supply port 60, and the other end of the auxiliary water supply pipe 166 may be connected to the switching unit 168.

The switching unit 168 may transmit water flowing through the water supply pipe 162 to at least one of the main water supply pipe 164 and the auxiliary water supply pipe 166. That is, water may be supplied to at least one of the main washing space 11*a* and the auxiliary washing space 110*a* through control of the switching unit 168. In addition, through the control of the switching unit 168, water supplied from the water supply pipe 162 may be supplied into the fixed tub 11 with detergent and/or softener via the detergent supply device 16. The switching unit 168 may be electrically connected to the controller 300.

Meanwhile, the auxiliary washing device 110 is not an essential component of the washing machine 1 according to the embodiment. That is, the washing machine 1 may not include the auxiliary washing device 110 and the auxiliary water supply pipe 166. Also, the washing machine 1 may not include the switching unit 168. In this case, the water supply pipe 162 may include the first water supply pipe 164*a* connected to the detergent storage space 16*a* of the detergent supply device 16 and the second water supply pipe 164*b* connected to the softener storage space 16*b*, the water supply valve 18 may include the first water supply valve 53 connected to the first water supply pipe 164*a* and the second water supply valve 54 connected to the second water supply pipe 164*b*.

Figure 4:
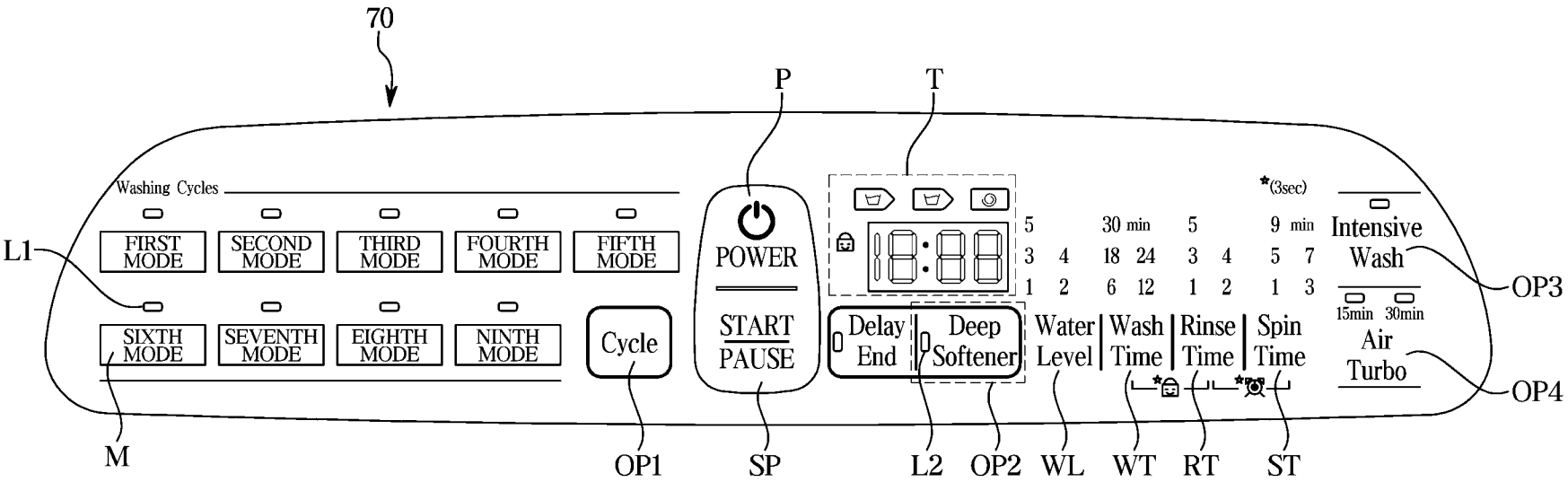
FIG. 4 is a view illustrating a control panel of a washing machine according to an embodiment.

FIG. 4 is a view illustrating a control panel of a washing machine according to an embodiment.

Referring to FIG. 4, the washing machine 1 may include a control panel 70 disposed on the top of the cabinet 10. The control panel 70 may receive an operation command of the washing machine 1 from a user, and may display operation information of the washing machine 1. The control panel 70 may include a plurality of buttons and displays. Also, the control panel 70 may be implemented as a single touch screen.

The control panel 70 may include a power button P controlling on/off of power of the washing machine 1 in the center. The power of the washing machine 1 may be turned on or off based on pushing and/or touching of the power button P by the user. When a power-on command is input by pushing and/or touching a power icon P, the control panel 70 may display various selectable user interface UI elements.

The control panel 70 may include a start/stop button SP for starting or stopping washing, and a plurality of washing mode buttons M for selecting a washing mode. A specific washing mode may be selected based on the push and/or touch of the specific washing mode button M by the user. Meanwhile, the control panel 70 may also include a separate cycle button OP1 to sequentially select a selection mode. The washing mode may be sequentially selected based on the push and/or touch of the cycle button OP1 by the user. The washing modes displayed as first to ninth modes may include a normal mode, a strong mode, a quick mode, a delicate mode, a soaking mode, a jeans mode, a duvet mode, a rinsing and dehydration mode, and a detergent-free washing mode.

Further, the control panel 70 may include an information display area T for displaying various information such as time information, a fragrance course button OP2 for selecting a softener adsorption process, a water height button WL for selecting a water height, a washing time button WT for selecting a washing time, a rinsing number button RT for selecting the number of rinsing times, a dehydration time button ST for selecting a dehydration time, a powerful washing course button OP3 for selecting a powerful washing process, an air turbo button OP4 for selecting an air turbo process, a water temperature button for selecting a water temperature, and the like. The above-described buttons may be implemented as icons.

In addition, the control panel 70 may include a plurality of indicators L1 and L2 indicating that the mode is activated. The plurality of indicators L1 and L2 may display the selected washing mode, the selected fragrance course, the selected water height, the selected number of rinsing times, the selected dehydration time, and the like. In addition, the control panel 70 may be variously designed.

Figure 5:
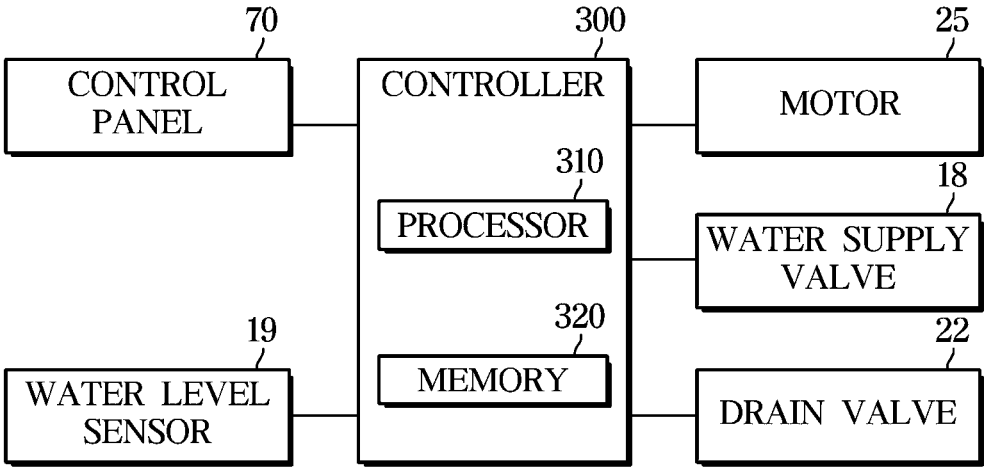
FIG. 5 is a control block diagram illustrating a washing machine according to an embodiment.

FIG. 5 is a control block diagram illustrating a washing machine according to an embodiment.

Referring to FIG. 5, the washing machine 1 may include the controller 300. The controller 300 may include a processor 310 and a memory 320. The controller 300 may be electrically connected to the control panel 70, the water level sensor 19, the motor 25, the water supply valve 18, and the drain valve 22. The controller 300 may control each component of the washing machine 1 that is electrically connected.

The motor 25 may include a driving circuit that supplies a driving current. The driving circuit may be electrically connected to the controller 300 and may supply the current to the motor 25 under the control of the controller 300. For example, the driving circuit may include an inverter circuit that supplies the current calculated to the motor 25 based on a speed command of the controller 300 and the rotation speed of the motor 25. In addition, the driving circuit may include a power switching circuit that allows or blocks current flow to the motor 25 in response to an on/off command of the controller 300. The controller 300 may control the rotation speed of the motor 25 by adjusting the amount of current applied to the motor 25.

The controller 300 may include the memory 320 for memorizing/storing programs, instructions, and data for controlling the operation of the washing machine 1, and the processor 310 for generating control signals to control the operation of the washing machine 1 according to the programs, instructions, and data memorized/stored in the memory 320. The processor 310 and the memory 320 may be implemented in separate chips or in a single chip. In addition, the controller 300 may include a plurality of the processors and a plurality of the memories.

The memory 320 may include volatile memories, such as Static Random Access Memories (S-RAMs), Dynamic RAMs (D-RAMs), or the like for temporarily storing data, and non-volatile memories, such as Read Only Memories (ROMs), Erasable Programmable ROMs (EPROMs), Electrically Erasable Programmable ROMs (EEPROMs), flash memories or the like for storing data for a long period of time.

The processor 310 may include logic circuits and operation circuits to process data under a program provided from the memory 320 and create a control signal according to the result of the process. For example, when the user inputs the command to select the washing mode by operating the control panel 70, the washing machine 1 may perform washing corresponding to the selected washing mode.

Meanwhile, the disclosure aims to maximize the adsorption rate of the softener for laundry. To this end, the disclosure performs the softener adsorption process in a final rinsing process. The softener adsorption process may refer to performing a rinsing process by setting a duty ratio of the motor 25 to stir the rotating tub 12 and/or the pulsator 50 left and right differently from a previous rinsing process. That is, a rinsing water flow may change according to the duty ratio setting of the motor 25. The duty ratio of the motor 25 may be defined as the ratio of on time of the motor 25 to one cycle. For example, when an on/off period of the motor 25 is 20 seconds, the on time of the motor 25 may be 10 seconds, and the off time of the motor 25 may be 10 seconds, the duty ratio of the motor 25 may be 0.5. or 50%.

The fragrance course may refer to the final rinsing process that performs the softener adsorption process. The fragrance course may be determined in advance based on the washing mode. In addition, the fragrance course may be provided as an option selectable by the user through the control panel 70. When the fragrance course is provided as the option, user convenience may be improved. Hereinafter, a method of controlling the washing machine 1 that can increase the adsorption rate of the softener will be described in detail.

Figure 6:
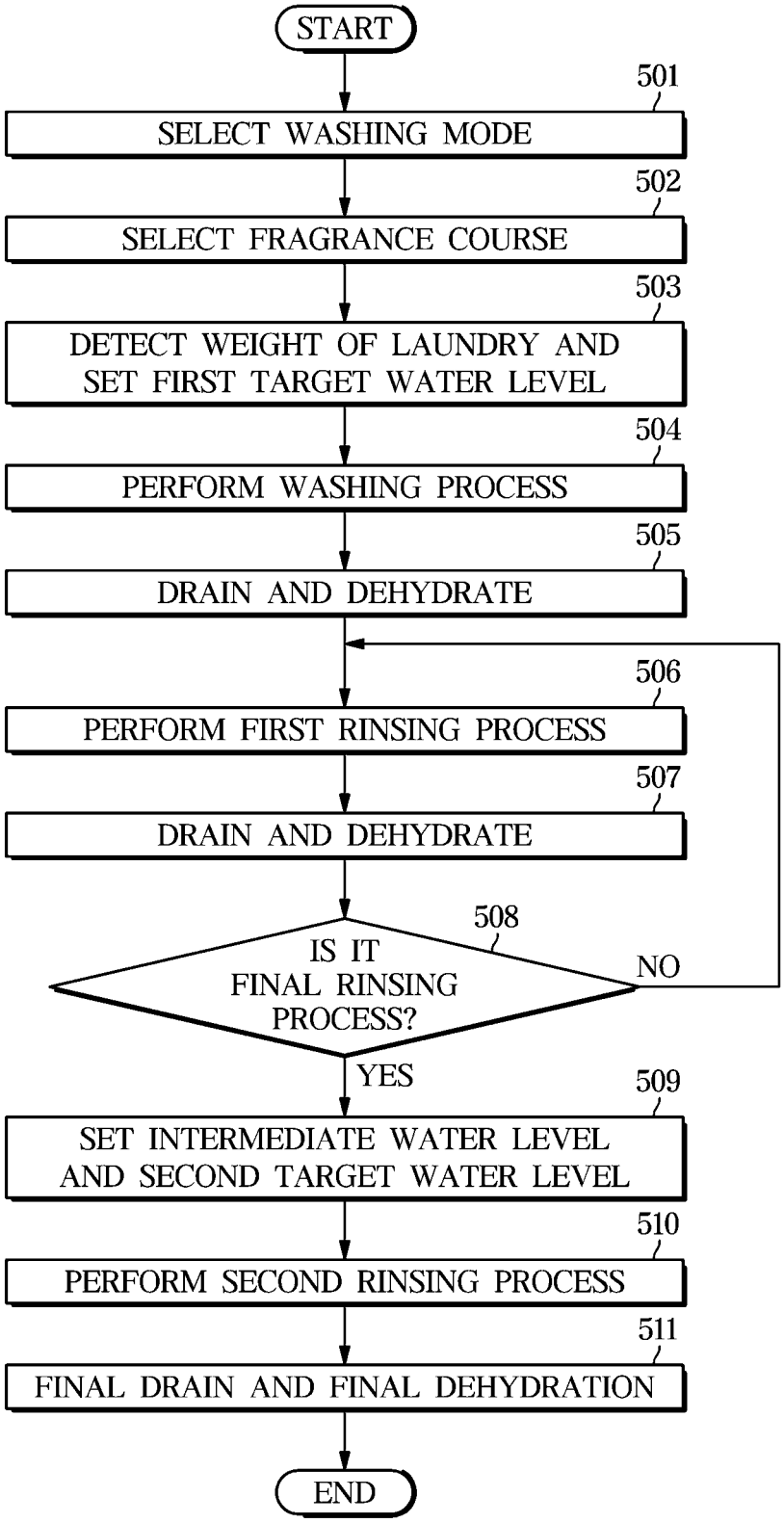
FIG. 6 is a flowchart illustrating an entire washing process performed by a washing machine according to an embodiment.

FIG. 6 is a flowchart illustrating an entire washing process performed by a washing machine according to an embodiment.

Referring to FIG. 6, an entire washing process is illustrated as including one washing, two rinsing, and three dehydrations, but the number of washing times, the number of rinsing times, and the number of dehydration times is not limited thereto.

First, the command for selecting the washing mode may be input through the control panel 70 (501), and the command for selecting the fragrance course may be input (502). For example, the normal mode may be selected and the fragrance course may be selected. When the fragrance course is selected, an algorithm of the final rinsing process included in the normal mode may be changed to a fragrance course algorithm.

Meanwhile, the controller 300 may activate the fragrance course button OP2 of the control panel 70 based on the washing mode. For example, when the washing mode is the normal mode, the controller 300 may activate the fragrance course button OP2, and the user may select the fragrance course through the fragrance course button OP2.

However, when the washing mode is the delicate mode, the controller 300 may deactivate the fragrance course button OP2. When the washing mode is the delicate mode, it may be inappropriate to set a second duty ratio of the motor 25 high in the final rinsing process. This is because the delicate mode requires the motor 25 to be driven at a relatively low duty ratio to prevent damage to the laundry. It may be inappropriate to perform the softener adsorption process in other washing modes as well as in the delicate mode.

Depending on a design, the final rinsing process of the specific washing mode (e.g., normal mode) may include the softener adsorption process, and in this case, a process of selecting the fragrance course may be omitted.

When the washing mode and the fragrance course are selected and a washing start command is input through the start/stop button SP, the controller 300 may detect a weight of the laundry and set a first target water level corresponding to the weight of the laundry (503). The first target water level may refer to the water level used in the washing process and the rinsing process other than the final rinsing process.

The weight detection of the laundry may be performed through various methods. For example, the controller 300 may drive the motor 25 to rotate the rotating tub 12, and may detect the weight of the laundry by detecting the current or the rotation speed of the motor 25 changing according to the load of the laundry in the rotating tub 12. The controller 300 may also set the washing time, the number of rinsing times, and the dehydration time based on the weight of the laundry.

The controller 300 may control the water supply valve 18 to supply water to the first target water level of the fixed tub 11 and perform the washing process (504). The controller 300 may perform the washing process based on the first target water level and the first duty ratio of the motor 25. The first duty ratio of the motor 25 may be predetermined in response to the washing mode. For example, when the washing mode is the normal mode, the first duty ratio may be 0.5 (the motor 25 on time/the motor 25 off time=1). In addition, the rotation speed (RPM) of the motor 25 for the washing process may also be predetermined in response to the washing mode.

The controller 300 may transmit the control signal to the driving circuit of the motor 25 for washing (or rinsing) to drive the motor 25. By driving the motor 25, the rotating tub 12 and/or the pulsator 50 may be stirred left and right, and contaminants (or detergent foam or residual detergent) of the laundry may be removed by the generated water flow. The left and right stirring may refer to that the rotating tub 12 and/or the pulsator 50 are periodically driven while alternating in forward and reverse directions at a constant RPM (e.g., 45 rpm). Of course, it is also possible to rotate the rotating tub 12 and/or the pulsator 50 using rotational profiles of other movements than the above-mentioned left and right stirring.

When the washing process is completed, the controller 300 may control the drain valve 22 to perform a drain process to discharge washing water in the fixed tub 11, and then perform the dehydrating process (505).

Subsequently, the controller 300 may control the water supply valve 18 to supply water to the first target water level of the fixed tub 11 and perform a first rinsing process (506). The controller 300 may perform the first rinsing process based on the first target water level and the first duty ratio of the motor 25. That is, in the washing process and the first rinsing process, the target water level may be the same, and the duty ratio of the motor 25 may also be the same.

However, the on/off cycle of the motor 25 in the washing process and the on/off cycle of the motor 25 in the first rinsing process may be different. That is, the on-time length of the motor 25 in the washing process and the on-time length of the motor 25 in the first rinsing process may be different. In addition, the target water level in the washing process, the target water level in the first rinsing process, and the duty ratio of the motor 25 in the first rinsing process and the duty ratio of the motor 25 in the washing process are not required to be the same, so they may be set differently from each other.

When the first rinsing process is completed, the controller 300 may control the drain valve 22 to perform the drain process that discharges rinsing water in the fixed tub 11, and then perform the dehydrating process (507).

Subsequently, the controller 300 may determine whether the next process is the final rinsing process (508), and when the next process is the final rinsing process, the controller 300 may set an intermediate water level and a second target water level (509). A second rinsing process may be defined as the final rinsing process. When the next process is not the final rinsing process, the controller 300 may perform the same rinsing process as the first rinsing process.

The controller 300 may set the second target water level lower than the first target water level. By setting the second target water level lower than the first target water level, a high concentration of softener may be included in the rinsing water. However, when the first target water level is a lowest water level, the controller 300 may set the second target water level to be the same as the first target water level. This is because an unbalance problem may occur when the second target water level is set lower, even though the first target water level is the lowest water level.

In addition, the controller 300 may also set the second duty ratio of the motor 25. The intermediate water level, the second target water level, and the second duty ratio may be set according to the selection of the fragrance course input through the control panel 70. The controller 300 may perform the second rinsing process based on the intermediate water level, the second target water level, and the second duty ratio of the motor 25 (510). When the second rinsing process is completed, the controller 300 may perform a final drain process and a final dehydrating process (511).

Figure 7:
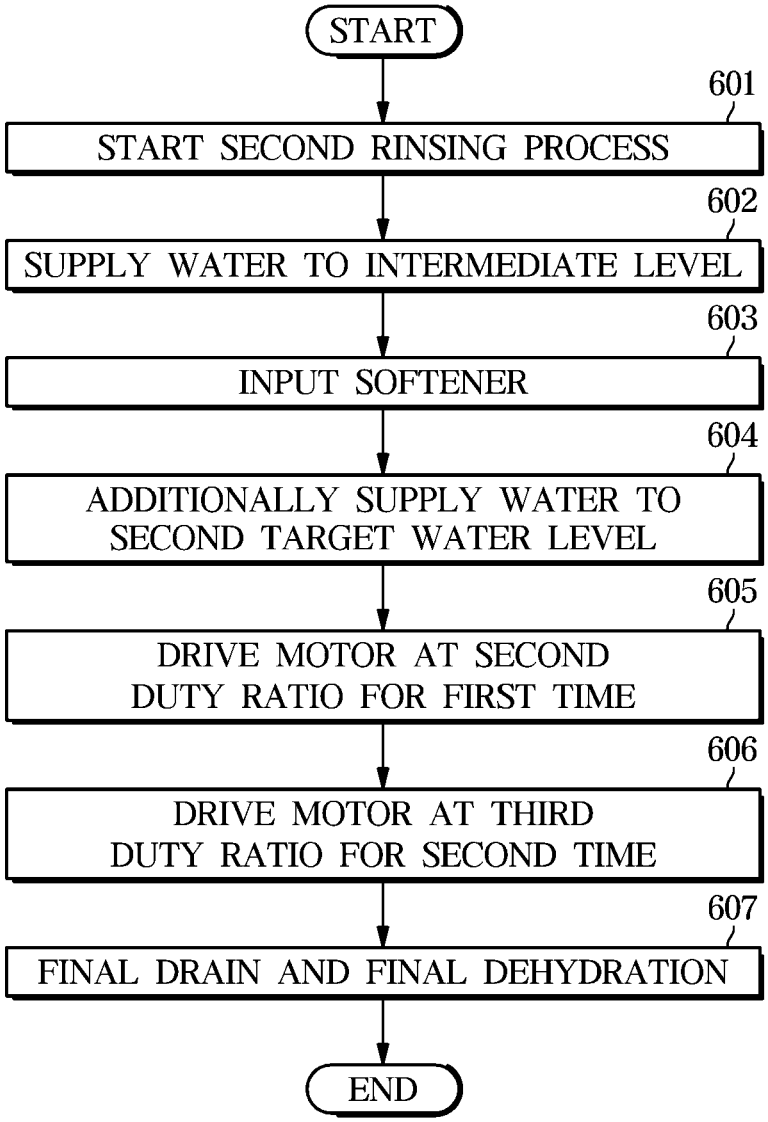
FIG. 7 is a flowchart illustrating a second rinsing process performed by a washing machine according to an embodiment.

FIG. 7 is a flowchart illustrating a second rinsing process performed by a washing machine according to an embodiment.

Referring to FIG. 7, when the second rinsing process is started, the controller 300 may control the water supply valve 18 to supply water to the intermediate level of the fixed tub 11 (601 and 602). The second rinsing process may be the final rinsing process. Subsequently, the controller 300 may control the water supply valve 18 to additionally supply water to the second target water level together with the softener stored in the detergent supply device 16 (603 and 604). The controller 300 may stir the pulsator 50 left and right for a predetermined time during additional water supply. By supplying the softener after watering the rinsing water to the intermediate level, it is possible to prevent the softener from settling. In addition, the softener may be better adsorbed by the laundry by driving the pulsator 50 for the predetermined time during the additional water supply.

In the second rinsing process, the controller 300 may set the duty ratio of the motor 25 to the second duty ratio higher than the first duty ratio, and may control the motor 25 to drive based on the second duty ratio to rotate the rotating tub 12 and/or the pulsator 50. Particularly, the controller 300 may drive the motor 25 at the second duty ratio for a first time during the initial driving of the motor 25 (605). For example, when the first duty ratio is 0.5, the second duty ratio may be 0.6. That is, when the on/off period of the motor 25 is 20 seconds, the on time of the motor 25 may be 12 seconds and the off time of the motor 25 may be 8 seconds.

Since the second duty ratio is higher than the first duty ratio, the water flow generated at the beginning of the second rinsing process may be stronger than the water flow generated at the first rinsing process. In addition, in the second rinsing process, the driving distance of the motor 25 may be increased by driving the motor 25 with a relatively high duty ratio at the initial stage of driving of the motor 25. Therefore, the number of effective collisions between the softener and the laundry may be increased, and the adsorption rate of the softener for the laundry may be increased.

In addition, the controller 300 may control the motor 25 to drive based on a third duty ratio lower than the first duty ratio for a second time after the first time elapses (606). For example, when the first duty ratio is 0.5, the third duty ratio may be 0.4. That is, when the on/off period of the motor 25 is 20 seconds, the on time of the motor 25 may be 8 seconds and the off time of the motor 25 may be 12 seconds.

Driving the motor 25 based on the third duty ratio for the second time may be defined as a laundry untangling process. That is, the second rinsing process may include the laundry untangling process. The adsorption of the softener may be stabilized by performing the laundry untangling process of driving the motor 25 based on the relatively low duty ratio. The second time may be determined to be longer than the first time. Also, the controller 300 may set the second time longer than the first time. The controller 300 may set the first time and the second time based on the washing mode.

The controller 300 may complete the second rinsing process after the second time has elapsed, and perform the final drain process and the final dehydrating process (607).

Figure 8:
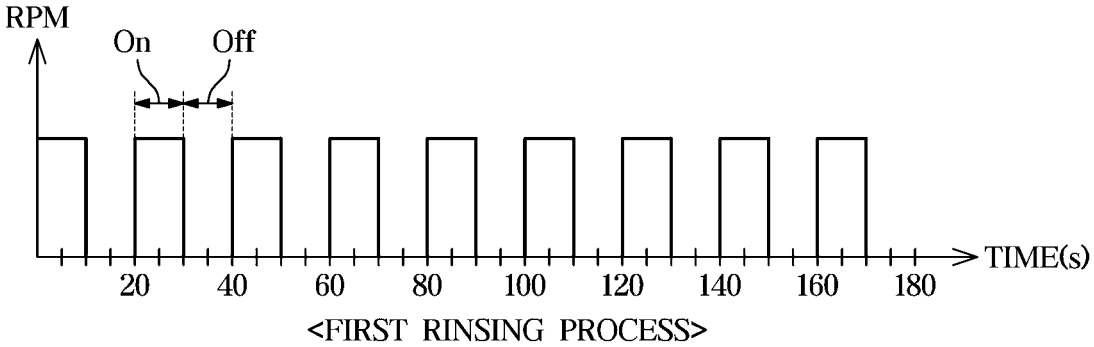
FIG. 8 is a view illustrating a motor driving method in a first rinsing process.
Figure 9:
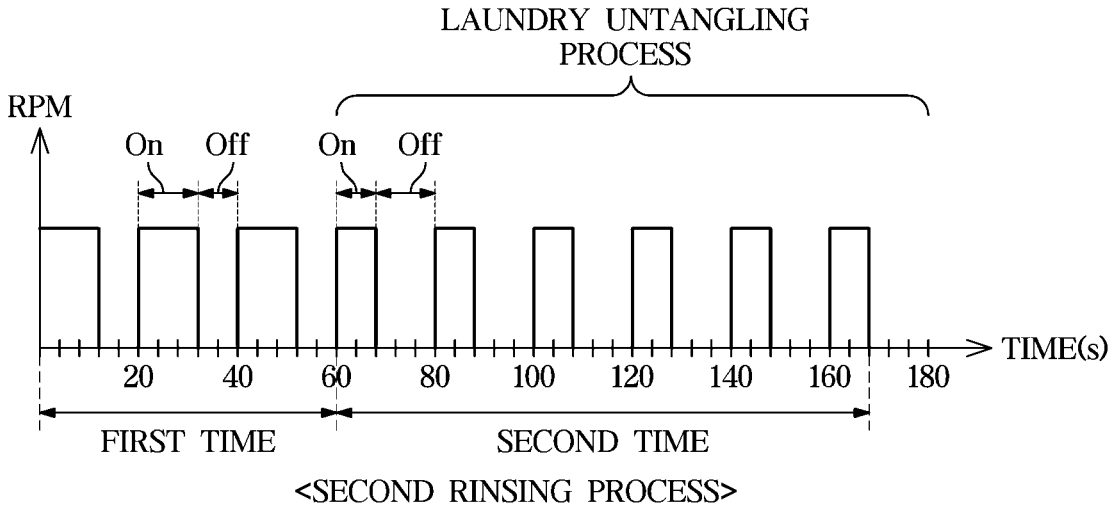
FIG. 9 is a view illustrating an example of a motor driving method in a second rinsing process.
Figure 10:
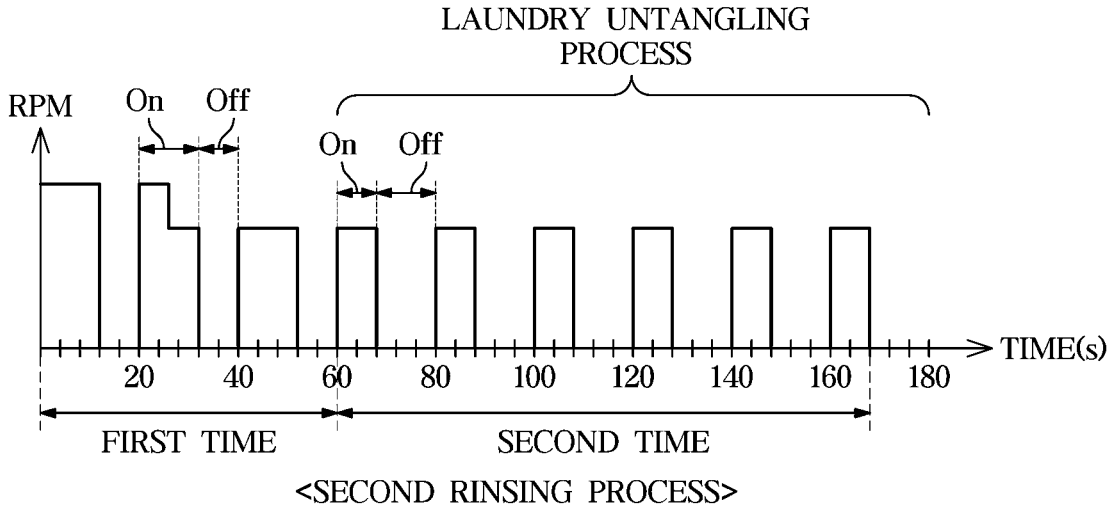
FIG. 10 is a view illustrating another example of a motor driving method in a second rinsing process.

FIG. 8 is a view illustrating a motor driving method in a first rinsing process, FIG. 9 is a view illustrating an example of a motor driving method in a second rinsing process, and FIG. 10 is a view illustrating another example of a motor driving method in a second rinsing process.

Referring to FIG. 8, the controller 300 may perform the first rinsing process based on the first duty ratio of the motor 25. For example, the first duty ratio may be 0.5. That is, when the on/off period of the motor 25 is 20 seconds, the on time of the motor 25 may be 10 seconds, and the off time of the motor 25 may be 10 seconds. Assuming that the first rinsing process is performed for 4 minutes, the motor 25 may be driven for 4 minutes at the first duty ratio in the first rinsing process. Accordingly, the rotating tub 12 and/or the pulsator 50 may be stirred left and right. The first duty ratio is not limited to 0.5. Therefore, the first duty ratio may have various values. Preferably, an average value of the first duty ratio over the entire time of the first rinsing process may be 0.45.

Referring to FIG. 9, when the second rinsing process is initiated, the controller 300 may perform the second rinsing process based on the second duty ratio of the motor 25. The second rinsing process may be defined as the final rinsing process. Particularly, the controller 300 may control the motor 25 to drive at the second duty ratio for the first time during the initial driving of the motor 25. For example, the second duty ratio may be 0.6. That is, when the on/off period of the motor 25 is 20 seconds, the on time of the motor 25 may be 12 seconds and the off time of the motor 25 may be 8 seconds. Also, assuming that the second rinsing process is performed for 4 minutes, it may be desirable that the first time is 1 minute.

When the motor 25 is driven as described above, the water flow generated at the beginning of the second rinsing process may be stronger than the water flow generated at the first rinsing process, and the driving distance of the motor 25 may be increased. Therefore, the number of effective collisions between the softener and the laundry may be increased, and the adsorption rate of the softener for the laundry may be increased.

The controller 300 may control the motor 25 to be driven based on the third duty ratio lower than the first duty ratio for the second time after the first time elapses. For example, the third duty ratio may be 0.4. That is, when the on/off period of the motor 25 is 20 seconds, the on time of the motor 25 may be 8 seconds and the off time of the motor 25 may be 12 seconds. Assuming that the second rinsing process is performed for 4 minutes, it may be desirable that the second time is 3 minutes.

Driving the motor 25 based on the third duty ratio for the second time may be defined as the laundry untangling process. The adsorption of the softener may be stabilized by performing the laundry untangling process of driving the motor 25 based on the relatively low duty ratio. Preferably, the average value of the second duty ratio and the third duty ratio with respect to the entire time of the second rinsing process may be a predetermined value (e.g., 0.45). The controller 300 may set the second duty ratio and the third duty ratio based on the predetermined average values of the second duty ratio and the third duty ratio.

Referring to FIG. 10, the controller 300 may increase the rotation speed (RPM) of the motor 25 for some time during the first time. In other words, the controller 300 may drive the motor 25 at the second rotation speed higher than a predetermined first rotation speed (RPM). The first rotation speed may be predetermined in response to the washing mode. When the rotation speed (RPM) of the motor 25 increases, the left and right stirring speeds of the rotating tub 12 and/or the pulsator 50 may be increased. Accordingly, the generated water flow may be stronger, and the driving distance of the motor 25 may be further increased. Therefore, the number of effective collisions between the softener and the laundry may be increased, and the adsorption rate of the softener for the laundry may be increased. However, the second duty ratio may be kept constant for the first time.

FIG. 11 is a view illustrating a setting of a second target water level.

Referring to FIG. 11, the washing machine 1 may divide the height of water that can be stored in the fixed tub 11 into 5 levels, but is not limited thereto. The water level sensor 19 may detect the frequency that changes according to the water level. The lower the frequency detected by the water level sensor 19, the higher the water level. The controller 300 may determine a current water level using the frequency detected by the water level sensor 19 and control the water supply valve 18 to supply water to the target water level.

FIG. 11 illustrates examples of the first target water level determined for the first rinsing process and the second target water level set for the second rinsing process according to the selection of the fragrance course when the washing mode is the normal mode. When the first target water level is determined as level 2 to level 5, the controller 300 may set the second target water level lower than the first target water level. In FIG. 11, when the frequencies corresponding to levels 2 to 5 are viewed, the frequency of the second target water level is 400 Hz higher than the frequency of the first target water level. That is, the second target water level is lower than the first target water level.

However, when looking at the frequency corresponding to the lowest level, level 1, the frequency of the first target water level and the frequency of the second target water level are the same. That is, when the first target water level is the lowest water level, the second target water level is set equal to the first target water level. This is because the unbalance problem may occur when the second target water level is set lower, even though the first target water level is the lowest water level.

Figure 12:
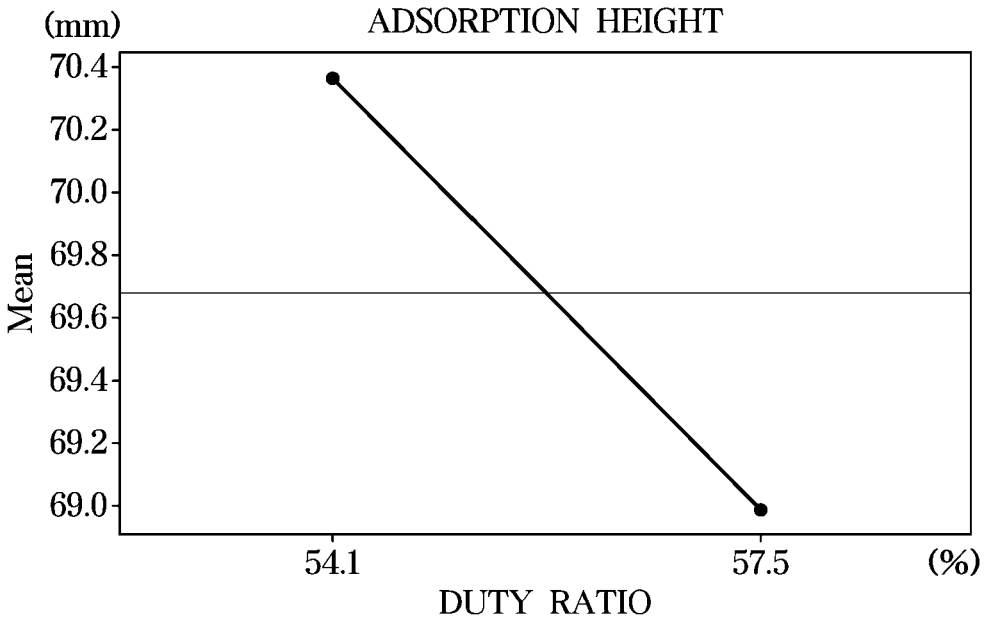
FIG. 12 is a graph illustrating an adsorption degree of softener according to a duty ratio of a motor.
Figure 13:
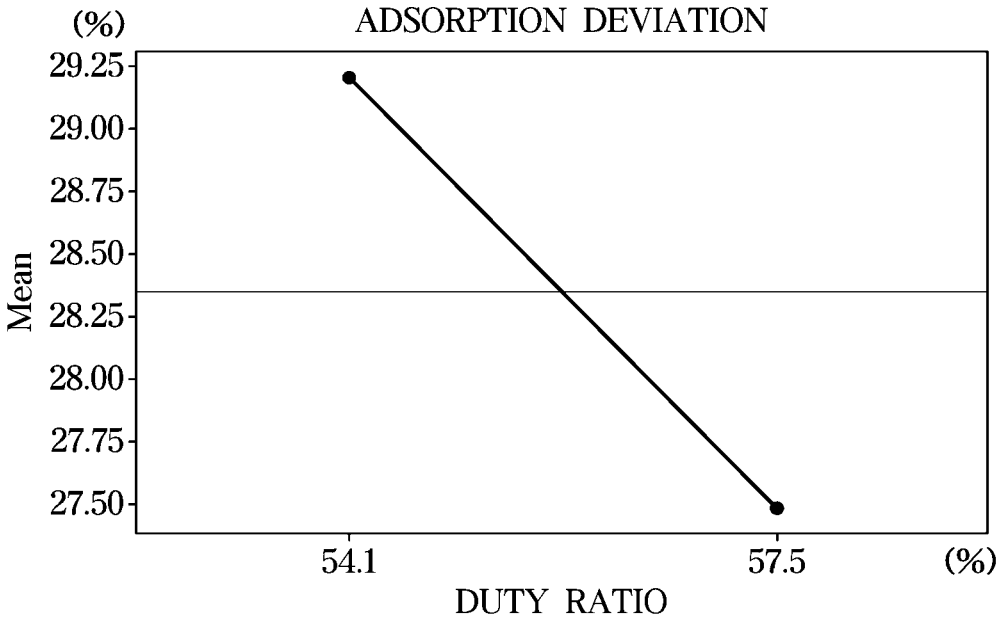
FIG. 13 is a graph illustrating an adsorption deviation of softener according to a duty ratio of a motor.

FIG. 12 is a graph illustrating an adsorption degree of softener according to a duty ratio of a motor, and FIG. 13 is a graph illustrating an adsorption deviation of softener according to a duty ratio of a motor.

FIGS. 12 and 13 illustrate the results of experiments using a chromatographic technique after performing the final rinsing process by varying the duty ratio of the motor 25. When the amount of softener dissolved in rinsing water is large, the softener adsorbed on a stationary phase may increase, and an adsorption height displayed on the stationary phase may be measured high. On the other hand, when the amount of softener dissolved in rinsing water is small because the softener is well adsorbed by the laundry, the softener adsorbed on the stationary phase decreases, and the adsorption height displayed on the stationary phase may be measured low.

In FIGS. 12 and 13, the duty ratio may refer to the second duty ratio of the motor 25. In FIG. 12, the softener adsorption height for the stationary phase is 70.4 mm when the second duty ratio is 54.1%, and the softener adsorption height for the stationary phase is 69.0 mm when the second duty ratio is 57.5%. That is, it can be seen that the adsorption rate of the softener for the laundry is high when the second duty ratio is set relatively high.

FIG. 13 illustrates an adsorption deviation of the softener for the stationary phase obtained by repeating the experiment multiple times. When the second duty ratio is 54.1%, the adsorption deviation for the stationary phase is 29.25%, and when the second duty ratio is 57.5%, the adsorption deviation for the stationary phase is 27.5%. Since the adsorption deviation for the stationary phase is smaller when the second duty ratio is 57.5%, it can be seen that the adsorption rate of the softener for the laundry is high when the second duty ratio is set relatively high.

Meanwhile, the processor 310 included in the controller 300 may generate the control signal for controlling the operation of the washing machine 1 based on programs/instructions and data memorized/stored in the memory 320. To this end, when the first rinsing process is performed based on the first target water level and the first duty ratio of the motor 25, and the second rinsing process is initiated, the memory 320 may store at least one instruction set by the processor 310 to control the water supply valve 18 to supply water to the intermediate water level of the fixed tub 11, to control the water supply valve 18 to supply additional water to the second target water level with the softener, to set the duty ratio of the motor 25 to the second duty ration higher than the first duty ratio, and to drive the motor 25 based on the second duty ratio.

In addition, the memory 320 may store at least one instruction set by the processor 310 to drive the motor 25 based on the second duty ratio for the first time, and to drive the motor 25 based on the third duty lower than the first duty ratio for the second time after the first time elapses.

Meanwhile, although the washing machine 1 has been described as the top loading washing machine, the method of controlling the washing machine according to the embodiment may be applied to a front loading washing machine, that is, a drum washing machine.

According to the method of controlling the washing machine and the washing machine according to an aspect, the adsorption rate of the softener for laundry may be increased.

According to the method of controlling the washing machine and the washing machine according to another aspect, the adsorption rate of the softener may be increased without changing specifications of an existing washing machine by optimizing the driving of the motor in the final rinsing process.

According to the method of controlling the washing machine and the washing machine according to another aspect, it is possible to improve the user's convenience by providing the fragrance course to increase the adsorption rate of the softener as an option.

The disclosed embodiments may be implemented in the form of a recording medium storing computer-executable instructions that are executable by a processor. The instructions may be stored in the form of a program code, and when executed by a processor, the instructions may generate a program module to perform operations of the disclosed embodiments. The recording medium may be implemented non-transitory as a computer-readable recording medium.

The non-transitory computer-readable recording medium may include all kinds of recording media storing commands that can be interpreted by a computer. For example, the non-transitory computer-readable recording medium may be, for example, ROM, RAM, a magnetic tape, a magnetic disc, flash memory, an optical data storage device, etc.

Embodiments of the disclosure have thus far been described with reference to the accompanying drawings. It should be obvious to a person of ordinary skill in the art that the disclosure may be practiced in other forms than the embodiments as described above without changing the technical idea or essential features of the disclosure. The above embodiments are only by way of example, and should not be interpreted in a limited sense.

Although the present disclosure has been described with various embodiments, various changes and modifications may be suggested to one skilled in the art. It is intended that the present disclosure encompass such changes and modifications as fall within the scope of the appended claims.

What is claimed is:

1. A method of controlling a washing machine, the washing machine including a motor configured to rotate a rotating tub rotatably provided in a fixed tub and a detergent supply device configured to store softener, the method comprising:

performing a first rinsing process based on a first target water level and a first duty ratio of the motor;

supplying water to an intermediate water level of the fixed tub based on a second rinsing process starting;

additionally supplying water to a second target water level together with the softener;

setting a duty ratio of the motor to a second duty ratio higher than the first duty ratio;

driving the motor based on the second duty ratio for a first time; and driving the motor based on a third duty ratio lower than the first duty ratio for a second time after the first time elapses.

2. The method according to claim 1, wherein the driving of the motor based on the second duty ratio comprises driving the motor at a second rotation speed higher than a predetermined first rotation speed.

3. The method according to claim 1, wherein the second time is longer than the first time.

4. The method according to claim 1, further comprising:

receiving an input from a user selecting a fragrance course through a control panel; and setting the intermediate water level and the second target water level based on the selection of the fragrance course, wherein the driving of the motor comprises setting the duty ratio of the motor based on the selection of the fragrance course.

5. The method according to claim 4, further comprising activating a fragrance course button of the control panel based on a washing mode.

6. The method according to claim 4, wherein the setting of the second target water level comprises setting the second target water level lower than the first target water level.

7. The method according to claim 4, wherein the setting of the second target water level comprises setting the second target water level to be the same as the first target water level based on the first target water level being a lowest water level.

8. The method according to claim 1, wherein the second rinsing process is a final rinsing process.

9. A washing machine comprising:

a fixed tub configured to store water;

a rotating tub rotatably provided in the fixed tub;

a motor configured to rotate the rotating tub;

a detergent supply device configured to store softener;

a water supply valve provided on a water supply pipe connected to the fixed tub; and a controller configured to:

perform a first rinsing process based on a first target water level and a first duty ratio of the motor, control the water supply valve to supply water to an intermediate water level of the fixed tub when a second rinsing process is started, control the water supply valve to supply additional water to a second target water level together with the softener, set a duty ratio of the motor to a second duty ratio higher than the first duty ratio, drive the motor based on the second duty ratio for a first time, and drive the motor based on a third duty ratio lower than the first duty ratio for a second time after the first time elapses.

10. The washing machine according to claim 9, wherein the controller is further configured to drive the motor at a second rotation speed higher than a predetermined first rotation speed.

11. The washing machine according to claim 9, wherein the second time is longer than the first time.

12. The washing machine according to claim 9, further comprising a control panel configured to receive an input from a user, wherein the controller is configured to set the intermediate water level, the second target water level, and the duty ratio of the motor based on a selection of a fragrance course inputted through the control panel.

13. The washing machine according to claim 12, wherein the controller is further configured to activate a fragrance course button of the control panel based on a washing mode.

14. The washing machine according to claim 12, wherein the controller is configured to set the second target water level lower than the first target water level.

15. The washing machine according to claim 12, wherein, when the first target water level is a lowest water level, the controller is configured to set the second target water level to be the same as the first target water level.

16. The washing machine according to claim 9, wherein the second rinsing process is a final rinsing process.

17. A washing machine comprising:

a fixed tub configured to store water;

a rotating tub rotatably provided in the fixed tub;

a motor configured to rotate the rotating tub;

a detergent supply device configured to store softener;

a water supply valve provided on a water supply pipe connected to the fixed tub;

at least one processor configured to be electrically connected to the motor and the water supply valve; and a memory configured to be electrically connected to the at least one processor, wherein the memory is configured to store at least one instruction set by the processor to:

perform a first rinsing process based on a first target water level and a first duty ratio of the motor, control the water supply valve to supply water to an intermediate water level of the fixed tub when a second rinsing process is started, control the water supply valve to supply additional water to a second target water level together with the softener, set a duty ratio of the motor to a second duty ratio higher than the first duty ratio, drive the motor based on the second duty ratio for a first time, and drive the motor based on a third duty lower than the first duty ratio for a second time after the first time elapses.

* * * * *